United States Patent [19]

Theurer et al.

[11] Patent Number: 4,608,928

[45] Date of Patent: Sep. 2, 1986

[54] TRACK-BOUND CARRIAGE FOR AN ASSEMBLED TRACK SECTION

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 735,625

[22] Filed: May 20, 1985

[30] Foreign Application Priority Data

Oct. 31, 1984 [AT] Austria ..... 3470/84

[51] Int. Cl.[4] ..... E01B 29/02

[52] U.S. Cl. ..... 104/3; 180/8.1; 280/763.1; 414/339

[58] Field of Search ..... 104/2–5; 414/339; 305/1; 180/8.1, 8.5; 280/763.1, 765.1, 766.1

[56] References Cited

U.S. PATENT DOCUMENTS

| | | | |
|---|---|---|---|
| 2,914,127 | 11/1959 | Ricouard | 180/8.5 |
| 3,576,225 | 4/1971 | Chambers | 180/8.5 |
| 4,249,467 | 2/1981 | Theurer et al. | 104/3 |
| 4,270,456 | 6/1981 | Theurer et al. | 104/3 |
| 4,516,503 | 5/1985 | Boccaletti | 104/3 |

FOREIGN PATENT DOCUMENTS

| | | | |
|---|---|---|---|
| 1759863 | 8/1971 | Fed. Rep. of Germany . | |
| 2309930 | 8/1974 | Fed. Rep. of Germany . | |
| 2432326 | 12/1975 | Fed. Rep. of Germany . | |
| 2619504 | 11/1977 | Fed. Rep. of Germany . | |
| 2749952 | 3/1979 | Fed. Rep. of Germany | 140/3 |
| 2905793 | 8/1980 | Fed. Rep. of Germany | 180/8.5 |
| 3340739 | 5/1984 | Fed. Rep. of Germany . | |
| 2104133 | 3/1983 | United Kingdom . | |

*Primary Examiner*—Randolph A. Reese
*Attorney, Agent, or Firm*—Kurt Kelman

[57] ABSTRACT

A track-bound carriage for receiving or laying an assembled track section from or on a track bed and for transporting the assembled track section in an operating direction, which comprises an elongated carrier frame, two undercarriages respectively supporting the forward and rear carrier frame halves on the assembled track section for movement therealong, each undercarriage including a flanged wheel engaging a respective one of the rails for support of the elongated carrier frame on the assembled track section, and a device for advancing the carrier frame stepwise in the operating direction, which includes two pairs of independently operable jacks arranged adjacent each other in the operating direction on each carrier frame half, each jack of each of the pairs being mounted at a respective one of the carrier frame sides outwardly spaced from a respective one of the tie ends, operation of the jacks vertically adjusting the jacks and enabling the jacks to engage the track bed, and one of the pairs of jacks on each carrier frame half being movable in relation to the other pair of jacks on each carrier frame half in the operating direction while the other pair of jacks engages the track bed and supports the elongated carrier frame thereon. A transversely adjustable rail gripping device at each one of the undercarriages detachably holds the assembled track section.

19 Claims, 9 Drawing Figures

TRACK-BOUND CARRIAGE FOR AN ASSEMBLED TRACK SECTION

The present invention relates to improvements in a track-bound carriage for receiving or laying an assembled track section from or on a track bed and for transporting the assembled track section in an operating direction, the assembled track section consisting of rails extending in the operating direction and fastened to ties having two ends.

German patent application No. 1,759,863, published Aug. 19, 1971, discloses such a track-bound carriage which comprises an elongated carrier frame having two sides defining planes extending in the operating direction, two undercarriages supporting the carrier frame, each undercarriage including a flanged wheel engaging a respective rail for support of the elongated carrier frame on the assembled track section, and a plurality of jacks mounted at a respective carrier frame side outwardly spaced from respective tie ends, the jacks being vertically adjustable for engagement with the track bed. Rail clamps are arranged on the carrier frame at the flanged wheels of the undercarriages for detachably gripping the rail heads to hold the assembled track section. When the assembled track section is to be laid in a trackless renewal section, the carriage or train of carriages holding the assembled track section is moved on bogies over an auxiliary track previously laid in the renewal section and the assembled track section is then lowered to the track bed on which it is laid. When it is desired to remove a track section, it is gripped and raised, an auxiliary track is laid under the raised assembled track section and the bogies are moved to provide a trackless renewal section. The use of auxiliary tracks in the rehabilitation operations makes them complicated and uneconomical, frequently leading to accidents because auxiliary tracks lack the fixed connections between the rails and ties and are somewhat loosely laid on a usually uneven track bed. In addition, auxiliary equipment, such as winches or the like, or raised track ramps are needed to place such carriages on the track. This is difficult and slow.

British patent application No. 2,104,133 A, published Mar. 2, 1983, relates to a gantry-mounted beam for railway track renewal. For this purpose, vertically adjustable gantry cranes are arranged in pairs on widely spaced auxiliary rails for movement transversely to the track and carry a bridge-like carrier. Transversely displaceable pairs of rail-gripping clamps are mounted at the ends of crossbeams to hold the assembled track section on the carrier. Since the auxiliary rails are spaced much wider than the length of the ties and the gantry cranes are, therefore, also spaced that widely, the entire arrangement requires a great deal of space and stops traffic over adjacent tracks or cannot be installed at all because of obstacles adjacent the renewal site. It also is difficult to erect and to dismantle. The use of auxiliary rails has all the disadvantages outlined hereinabove, in addition to which the very wide auxiliary track gauge causes difficulties in the way of an accurate and solid installation. Generally speaking, the use of auxiliary tracks makes stable track rehabilitation operations impossible. Furthermore, the erection, dismantling and transportation of such a large installation is complex and correspondingly uneconomical.

German patent application No. 2,619,504, published Nov. 10, 1977, also proposes the use of gantry cranes equipped with elongated carriers for laying ties, rails and assembled track sections. The gantries run on auxiliary transverse tracks of regular gage, which improves their usefulness but still involves the noted disadvantages of auxiliary tracks.

U.S. Pat. No. 4,249,467, dated Feb. 10, 1981, discloses a mobile apparatus for receiving and laying assembled track switch sections, which comprises an elongated bridge-like carrier frame supported at each end by undercarriages and equipped with hoist means for gripping and transporting assembled track sections. This apparatus does away with auxiliary tracks and provides a robust and very stable track renewal installation. However, it constitutes a rather complicated structure and the track-laying undercarriages supporting the carrier frame in the trackless renewal section make an accurate positioning during the renewal operation rather cumbersome and difficult.

A somewhat similar apparatus is disclosed in German patent application No. 3,340,739, published May 30, 1984. The end undercarriages are vertically adjustable with the carrier frame supported thereon and transversely adjustable trolleys with rail clamps are mounted on the carrier frame for holding the assembled track section. The arrangement is generally more complicated than that of the apparatus disclosed in the U.S. patent and, therefore, is less economical and more prone to operational failures than that apparatus.

U.S. Pat. No. 4,270,456, dated June 2, 1981, discloses a mobile apparatus for receiving and laying an assembled track section, which comprises a track-bound transport vehicle and an overhead girder extending above the vehicle and connected thereto by laterally displaceable gantry supports which comprise vertically adjustable jacks for engagement with the track bed. The girder projects beyond an end of the vehicle and has a guide track for a trolley moving therealong and including vertically adjustable hoisting means for lifting and lowering a respective track section and for conveying it along the guide track. The girder is pivoted on the vehicle for lateral displacement and the gantry supports are independently vertically and laterally adjustable to permit hoisted assembled track sections to move freely when conveyed along the guide track. While this apparatus is quite stable in operation and is capable of handling heavy track switches as well as very long assembled track sections of different configurations, it has quite a complicated structure.

It is the primary object of this invention to overcome the various disadvantages of track-bound carriages of the indicated type by providing a relatively simple structure which permits an improved handling of assembled track sections during track rehabilitation operations.

The above and other objects are accomplished according to the invention with a track-bound carriage which comprises an elongated carrier frame having two sides defining planes extending in the operating direction and the carrier frame having a forward half and a rear half, and two undercarriages respectively supporting the forward and rear carrier frame halves on the assembled track section for movement therealong, each one of the undercarriages including a flanged wheel engaging a respective one of the rails for support of the elongated carrier frame on the assembled track section. It further comprises a device for advancing the carrier frame stepwise in the operating direction, the carrier frame advancing device including two pairs of independently operable jacks arranged adjacent each other in the operating direction on each carrier frame half, each jack of each of said pairs being mounted at a respective one of the carrier frame sides outwardly spaced from a respective one of the tie ends, operation of the jacks vertically adjusting the jacks and enabling the jacks to engage the track bed, and means for moving one of the pairs of jacks on each carrier frame half in relation to the other pair of jacks on each carrier frame half in the operating direction while the other pair of jacks engages the track bed and supports the elongated carrier frame thereon. A rail gripping device at each one of the undercarriages detachably holds the assembled track section, each rail gripping device being adjustable transversely with respect to the operating direction.

Such a track-bound carriage enables assembled track sections to be received and laid relatively rapidly for transport on railroad cars during a track renewal operation and, for the first time, overcomes the problems encountered in the accurate positioning of the assembled track section on the usually uneven track bed in the track renewal section by the stepwise advance of the stilt-like support for the carriage holding the assembled track section. The track-bound carriage holding the assembled track section advances step by step in the operating direction to the desired position by alternately vertically extending and retracting the adjacent pairs of jacks so that the extended jacks support the carriage on the track bed while the retracted jacks move forward. By using either a single carriage or a series of carriages, it is possible to handle either short or very long assembled track sections, including track switches, rapidly and securely. Such a stepwise advancing carriage may be put in operation substantially without any preparatory work and without auxiliary tracks which may stop traffic on adjacent tracks.

The above and other objects, advantages and features of the present invention will become more apparent from the following detailed description of a now preferred embodiment thereof, taken in conjunction with the accompanying, partly schematic drawing wherein FIG. 1 is a fragmentary side elevational view of a mobile apparatus for receiving or laying a long assembled track section from or on a track and for transporting the assembled track section in an operating direction, which comprises two coupled flat cars, a locomotive driving the flat cars in the operating direction, and two track-bound carriages carried by the flat cars, one of the carriages according to this invention being illustrated in this figure;

Figures 4, 5, 6, 7, 8, 9:
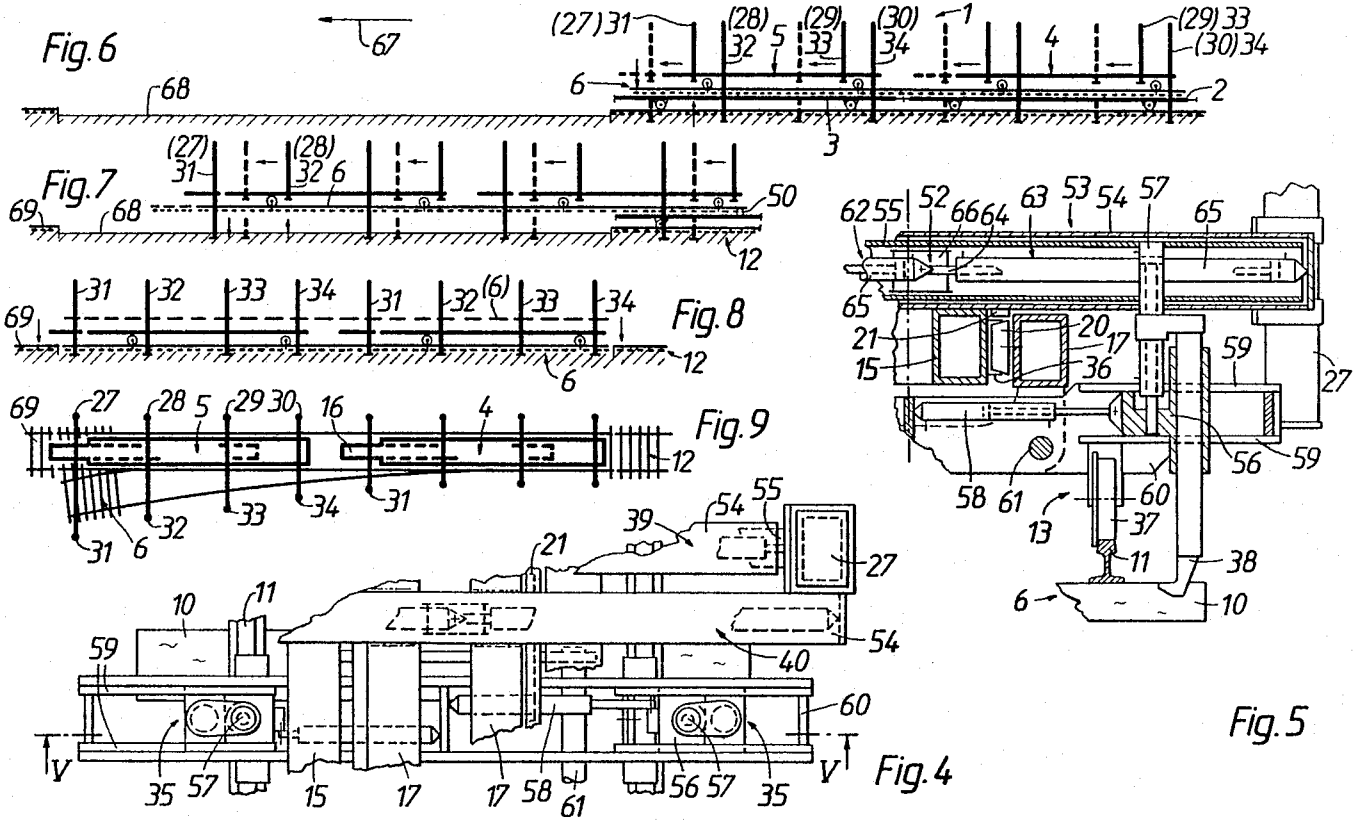
FIG. 4 is an enlarged, fragmentary top view of a pair of jacks connected to a beam movable in the operating direction and of the rail gripping device shown on the left side of FIG. 2.
FIG. 5 is a section along line V—V of FIG. 4, illustrating the telescoping transverse drives for the jacks partly in section.

FIGS. 6 to 8 diagrammatically illustrate various operating positions of the apparatus handling a track switch; and FIG. 9 diagrammatically shows a top view of the end position of the track switch laid on the track bed in the operating stage illustrated in FIG. 8.

Figures 1, 2, 3:
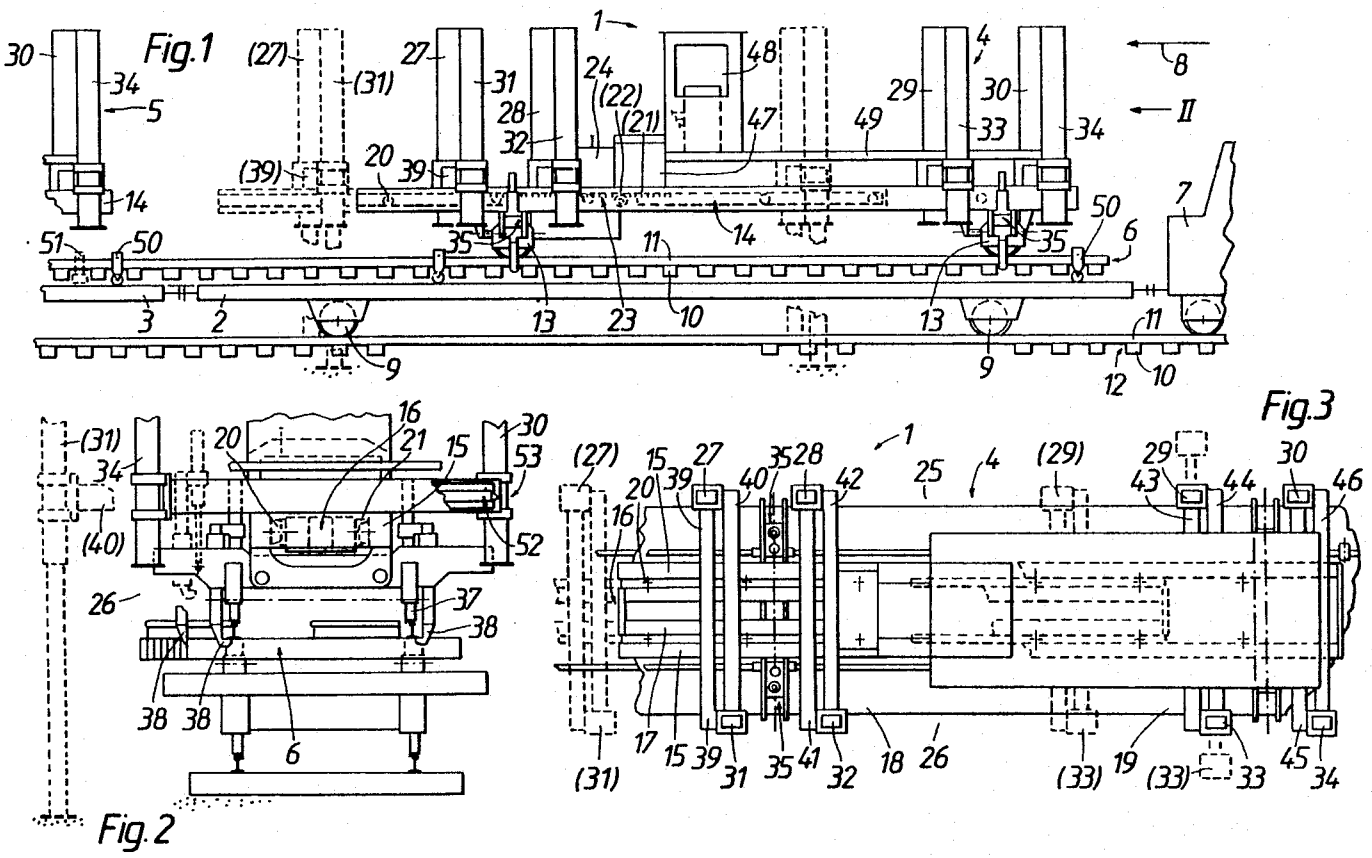
FIG. 2 is an enlarged end view of the track-bound carriage and the flat car carrying it, seen in the direction of arrow II in FIG. 1.
FIG. 3 is a top view of the track-bound carriage of FIG. 1.

Referring now to the drawing and first to FIGS. 1 to 3, there is shown mobile apparatus 1 for handling, i.e. receiving or laying long assembled track section 6 from or on a track bed and for transporting the assembled track section in an operating direction indicated by arrow 8. The assembled track section consists of rails 11 extending in the operating direction and fastened to ties 10 having two ends. The illustrated apparatus comprises two coupled flat cars 2, 3 mounted for mobility on track 12 supported on the track bed, which track is constituted by a previously laid assembled track section consisting of rails 11 fastened to ties 10. Means for driving the coupled flat cars in the operating direction indicated by arrow 8 is illustrated as locomotive 7 pushing the flat cars towards a trackless gap in the track where assembled track section 6 is to be laid during a track rehabilitation operation. Two successively arranged track-bound carriages 4, 5 are mounted on coupled flat cars 2, 3 and assembled track section 6 is supported over its entire length on the coupled flat cars while it is held on track bound carriages 4, 5 and handled in the manner to be described fully in connection with FIGS. 6 to 8.

By using two successively arranged carriages on two coupled flat cars, it is possible to handle long assembled track sections of a length of, for example, 30 m, including track switches, in a very effective manner. During a track rehabilitation operation, the carriages may be used singly, of course, for handling shorter track sections and, on the other hand, some very long or heavy assembled track sections may require the use of three carriages.

Each track-bound carriage comprises elongated carrier frame 14 having two sides 25, 26 defining planes extending in the operating direction. The carrier frame has forward half 18 and rear half 19. Two undercarriages 13 respectively support the forward and rear frame halves on assembled track section 6 for movement therealong, each undercarriage including flanged wheel 37 engaging respective rail 11 for support of elongated carrier frame 14 on assembled track section 6. The illustrated undercarriages are single-axle bogies carrying a pair of the flanged wheels. In accordance with the invention, each track-bound carriage further comprises a device for advancing carrier frame 14 stepwise in the operating direction. The carrier frame advancing device includes two pairs of independently operable jacks 27, 31 and 28, 32 arranged adjacent each other in the operating direction on front carrier frame half 18 and two pairs of independently operable jacks 29, 33 and 30, 34 arranged adjacent each other in the operating direction on rear carrier frame half 19. Each jack of each pair is mounted at a respective carrier frame side 25, 26 outwardly spaced from respective tie ends, operation of the jacks vertically adjusting the jacks and enabling the jacks to engage the track bed for support of the elongated carrier frame thereon. The carrier frame advancing device further includes means for moving one of the pairs of jacks 27, 31 and 29, 33 on each carrier frame half 18 and 19 in relation to the other pair of jacks 28, 32 and 30, 34 on each carrier frame half in the operating direction while the other pair of jacks engages the track bed and supports elongated carrier frame 14 thereon.

Each carriage also has rail gripping device 35 at each undercarriage 13 for detachably holding assembled track section 6, each rail gripping device being adjustable transversely with respect to the operating direction. As shown in FIG. 2, rail gripping device 35 comprises vertically adjustable gripping hook 38 opposite flanged wheel 37 of associated undercarriage 13 to hold the assembled track section at both rails at the outside thereof.

In the illustrated embodiment, drive 39 to 46 is connected to each jack 27 to 34 and is independently operable to adjust the jack transversely with respect to the operating direction whereby the carrier frame advancing device is transversely adjustable (see positions of jacks 29 and 33 indicated in broken lines in FIG. 3, and position of jack 31 transversely adjusted by drive 40 indicated in broken lines in FIG. 2 at side 26, which figure also shows in broken lines the transversely adjusted position of a gripping hook 38 for gripping a portion of a wide track switch). Each drive provides a transverse adjustment range extending outwardly from an adjacent tie end. This transverse adjustability of each jack enables the track-bound carriages simply, rapidly and economically to handle track switches and other relatively wide and heavy assembled track sections with great safety during the replacement operation. The individual movability of the jacks in, and transversely to, the operating direction enables the elongated carrier frame holding the assembled track section to execute a desired pivoting motion in a curve. Therefore, switches and curved assembled track sections of all types may be very carefully and accurately positioned. This can be accomplished with the same number of jacks and requires no additional equipment. Also, such wide assembled track sections, which may interfere with traffic on adjacent tracks, may thus be selectively repositioned to the left or right while they are being transported so as to clear such traffic or avoid obstacles. This is readily accomplished with the selective transverse adjustment of the stilt-like carrier advancing device provided by the pairs of jacks. The alternating extension and retraction of the adjacent pairs of jacks and the transverse adjustment of one pair with respect to the adjacent pair enables the device to advance the elongated carrier frame at each step in the desired transverse position. This forward and sideward movement makes it possible to handle and properly to position even the most difficult track switches.

The illustrated carriage further comprises a central remote control for operating each jack and drive independently, the drives being operable into a retracted position wherein the carriage may pass freely with the normal profile of the track. This central remote control is illustrated by power supply installation 47 and operator's cab 48 mounted on operating stage 49. In the retracted position of the jacks, the carriage may be readily moved along the track, with its supporting flat car forming part of a train. The central remote control permits the apparatus to be operated economically while enhancing the safety and efficiency of the handling of the assembled track section.

The illustrated jacks 27 to 34 and drives 39 to 46 are double-acting hydraulic piston-and-cylinder devices 52 (more fully described hereinbelow in connection with FIGS. 4 and 5) comprised of telescoping arrangement 53 protected not only against mechanical stresses but also against dirt and the like. The drives extend beyond carrier frame sides 25 and 26 and have a length corresponding at least to the length of the ties in their retracted position and about double the tie length in their extended position. The telescoping arrangements are preferably all of the same shape and have the same length. They are comprised of telescoping parts of rectangular cross section. This arrangement is particularly simple and has a robust structure assuring trouble-free operation. The rectangular cross section of the telescoping parts provides a closed structure assuring a long operating life for the jacks and drives while assuring high force transmission, which is of particular importance in the handling of heavy track switches. If all the telescoping devices are of the same length, they may be readily replaced.

As shown in FIGS. 4 and 5 in connection with drives 39 and 40, outer telescoping parts 54 of the drives are affixed to struts 17 of displaceable beam 16 of the elongated carrier frame and extendible inner telescoping parts 55 of the drives are affixed to outer telescoping parts 54 of the associated jacks. As shown in FIG. 3, the outer telescoping parts of pairs of adjacent drives are offset from each other by 180°. Each telescoping arrangement 53 is closed by end plates. Double-acting hydraulic cylinder-piston drive 52 is arranged in each closed telescoping arrangement and is comprised of two sequentially arranged cylinder-piston devices 62, 63 linked by one piston rod 64 and cylinder 65 to central guide member 66 for guidance in inner telescoping part 55 while the other cylinder 65 is connected to the end plate of outer telescoping part 54 and the other piston rod 64 is connected to the associated end plates of inner telescoping part 55 and outer telescoping part 54 of the jack. In such an arrangement, it is possible to place the hydraulic conduits leading to the two cylinders without difficulty in the corner regions of the rectangular telescoping parts while assuring a large displacement stroke.

As shown in the drawing, elongated carrier frame 14 has a width fitting the carrier frame between rails 11 of assembled track section 6 and the carrier frame is centered between the rails. The illustrated carrier frame comprises two parallel, interconnected carrier struts 15 extending in the operating direction, the other pair of jacks 28, 32 and 30, 34 on each carrier frame half 18 and 19 being mounted on the carrier struts, and elongated beam 16 extending between carrier struts 15 and movable in the operating direction with respect to the carrier struts, the one pair of jacks 27, 31 and 29, 38 on each carrier frame half being mounted on the movable elongated beam whereby the beam constitutes the means for moving these pairs of jacks. The elongated beam also comprises two parallel, interconnected carrier struts 17. Carrier struts 15 and 17 have the same rectangular cross section.

Outer telescoping parts 54 of transverse drives 39 to 46 are affixed to beam 16. Each elongated beam carrier strut 17 has U-shaped elongated guide track 36 in the range of the front and rear carrier frame halves, and guide rollers 20 mounted on fixed carrier struts 15 engage elongated guide tracks 36 to enable beam 16 to be displaced with respect to carrier struts 17. Drive means for moving elongated beam 16 in the operating direction forwardly of a front end of the carriage comprises preferably hydraulic motor 24 mounted on elongated carrier frame 14 and a transmission preferably comprising rack-and-pinion drive 21, 22 connecting the driving output of the motor to the elongated beam. FIG. 1 shows in broken lines one displacement position of elongated beam 16 with extended jacks 27, 31 and 29, 33 supporting the carriage on the track bed after the carriage has been advanced by one step. The range of the advancing movement of the drive means extends preferably over at least three to four tie spacings. In this illustrated embodiment, outer telescoping parts 54 of drives 41, 42 and 45, 46 are affixed to carrier struts 15 while the other outer telescoping parts of adjacent drives 39, 40 and 43, 44 are affixed to beam struts 17.

The illustrated arrangement wherein the fixed jacks are mounted on two carrier struts of the narrow elongated carrier frame and the movable jacks are mounted on an elongated beam of the carrier, which is displaceable longitudinally with respect to the two carrier struts and is guided therebetween provides a very simple and robust telescoping structure which withstands the highest stresses to which the elongated carrier frame is subjected in the handling of very heavy track switches and the like. Mounting the outer telescoping parts of one of the drives on the carrier struts offset from the other telescoping parts of the adjacent drives by 180° and the other telescoping parts of the adjacent drive on the elongated beam while affixing the outer telescoping parts of the jacks to the inner telescoping parts of the drives provides a very simple structure which is easy to service, the frequently high stresses encountered during the handling of heavy assembled track sections being absorbed in this structure not only by the carrier frame but also by the connected telescoping structural parts. If the carrier frame struts are of substantially the same rectangular cross section as the telescoping parts, the entire structure may be economically assembled with fitting and largely interchangeable parts. The hydraulic motor and rack-and-pinion transmission enabling the elongated carrier frame beam in the operating direction by at least three to four tie spacings enables the apparatus to advance efficiently and with a minimum of steps, with an initial step of about 2.5 m, for example, while holding the total length of the carriage to a required minimum. The transverse drive for the jacks enables the elongated carrier frame to be laterally adjusted while keeping the jacks in their transversely retracted position close to the ends of the ties.

As shown in the drawing, each undercarriage 13 is preferably arranged between adjacent pairs of the jacks, i.e. the jacks are mounted at respective sides of flanged wheels 37 of the undercarriages. This arrangement produces a particularly robust and stress-resistant structure.

As can be seen in FIG. 2, respective pairs of gripping hooks 38 are arranged for engaging the outsides of the rails of the assembled track section. FIG. 5 shows each gripping hook to be vertically adjustably mounted in guide member 56 and to be vertically adjustable by hydraulic cylinder-piston drive 57 which is affixed to the guide member. The guide member is transversely adjustably mounted in guide 59 of transverse beam 60 affixed to elongated carrier frame 14, which also carries flanged wheels 37 of the undercarriages. Hydraulic cylinder-piston device 58 is affixed to the transverse beam and connected to gripping hook guide member 56 for transversely adjusting the gripping hook. The adjustable positioning of the gripping hooks enables the rail gripping device to operate effectively with the most difficult configurations of the assembled track section. With the gripping hook opposite the flanged wheel of the undercarriage, the rail gripping device can be very effectively used for holding track switches. At the same time, the flanged wheels of the undercarriages are used also as counter-supports for the gripping hooks in the gripping devices. Transverse beam 60 is attached to elongated carrier frame 14 and, as shown in FIG. 4, it is displaceable in the operating direction along guide axles 61, together with the flanged wheels of the undercarriages and the gripping hooks. This arrangement will enable the carriage to be used for handling the most complicated and also very wide assembled track sections efficiently and safely.

The length of carriages 4, 5 is preferably substantially the same as that of standard railroad cars so that each carriage can hold an assembled track section having a length of about 15 m or more. Thus, a track section having a length of about 30 m may readily be handled by two such carriages without the track section projecting much beyond the ends of the carriages. Three sequentially arranged carriages can safely handle assembled track sections, including track switches, having a length of 40 m or more. The longitudinal displacement of elongated beam 16 of the carrier frame may span about 3 to 4 tie spacings or a distance of about 2.6 m so that only a few steps are needed to advance the distance of a length of the carriage. In handling an assembled track section having a length of about 15 m, about 5 to 6 steps will be required to advance the track section over the entire trackless section on which the assembled track section is to be laid.

The length of telescoping arrangements 53 of the jacks and transverse drives may preferably be slightly in excess of the tie length in the retracted position, i.e. about 2 m, and about 4 m in the extended position so that an adjacent pair of jacks 27, 31; 28, 32; 29, 33; 30, 34 may span a distance of about 6 m upon extension and subsequent engagement with the track bed to support the carriage thereon. This enables the carriage to be used even for very wide track switches. On the other hand, in the retracted positions of telescoping arrangements 53, the jacks will enable the carriage to pass freely within the profile of a tangent track along which it is moved.

FIGS. 6 to 9 illustrate one possible operation of apparatus 1 comprising two coupled flat cars 2, 3 and two track-bound carriages 4, 5 mounted on the coupled flat cars, for receiving, transporting and laying assembled track section 6 comprised of rails 11 fastened to ties 10.

After the apparatus loaded with the assembled track section has been moved by locomotive 7 in the direction of arrow 67 to trackless renewal section 68, all jacks 27 to 34 are lowered into engagement with the track bed sufficiently to lift assembled track section 6 carried by carriages 4, 5 slightly off flat cars 2 and 3 so that auxiliary rollers 50 and 51 for moving the assembled track section on the flat cars in, and transversely to, the operating direction may be placed beneath the carriages. This will facilitate the movement of the assembled track section in either direction on the flat cars during centering of the assembled track section when it is laid on the trackless renewal section. Auxiliary rollers 51 for the transverse movement of the assembled track section facilitate the transverse movement of the wider front portion of a track switch so that it may be displaced from its originally more or less centered position on flat car 3 to the laterally offset position shown in FIG. 9. For this purpose, the jacks 31 to 34 of carriage 5 are also laterally extended to the positions shown in FIG. 9. The auxiliary rollers are not absolutely required for the transverse movement of the assembled track section but they will facilitate this movement. The lateral displacement of the assembled track section is effected while it is still supported on flat cars 2, 3 since these flat cars running on the track form a solid support for the assembled track section.

The first advancing step is effected by the displacement of the two elongated beams 16 in the operating direction by moving drive means 23, causing the pairs of jacks 27, 31 and 29, 33 to advance into the positions indicated in broken lines in FIG. 6. After these pairs of jacks have been advanced, the jacks are lowered into engagement with the track bed. After the elongated carrier frames of the carriages are thus supported on the track bed, the pairs of jacks 28, 32 and 30, 34 of the two carriages 4, 5 are retracted and moved with elongated carrier frame 14 in the direction of arrow 67 to execute the actual second advancing step with assembled track section 6 which is gripped by hooks 38 during the advancement of the carriages. This alternating operation of the respective pairs of jacks is repeated until the assembled track section has been moved completely over trackless renewal section 68.

FIG. 7 illustrates an intermediate position during the laying operation, the front pairs of jacks 27, 31 and 29, 33 having first been lowered, the pairs of jacks 28, 32 and 30, 34 having then been retracted and having been advanced by drive means 23 in the position shown in broken lines.

FIG. 8 shows the end position in which assembled track section 6 has been longitudinally and transversely centered over trackless section 68 so that it is ready to be laid, as shown in FIG. 9. In this position, all the jacks engage the track bed and the track section can be laid adjoining next succeeding track section 69 which is to be replaced in a subsequent operation.

The removal of an assembled track section by apparatus 1 proceeds in the reverse manner, as will be explained hereinbelow.

Apparatus 1 will be moved over assembled track section 69 and properly centered for receiving the track section. After the assembled track section has been detached from the track and gripped by rail gripping devices 35 of carriages 4, 5, the carriages are advanced analogously in the reverse direction over the two flat cars 2, 3 which, in the meantime, have been moved by locomotive 7 into a position adjoining assembled track section 69 (where track section 6 has been previously laid). As soon as carriage 5 has been positioned over flat car 3, it can be supported on the flat car and, if desired, moved thereon on auxiliary rollers 50. After track section 69 has been fully placed on apparatus 1, it can be transported away with the apparatus.

Lateral displacement of assembled track sections may also be effected by apparatus 1 in the following manner:

After the assembled track section has been moved to the desired location, it is lifted off the flat cars and these cars are moved away. Carriages 4, 5 now are transversely displaced by advancing the same transversely by steps of about 1 m until the location has been reached where it is desired to place the track section. The assembled track section is then deposited at that location and the empty carriages are returned step by step to the track. The flat cars are now moved back to subtend the carriages for support thereof.

What is claimed is:

1. A track-bound carriage for receiving or laying an assembled track section from or on a track bed and for transporting the assembled track section in an operating direction, the assembled track section consisting of rails extending in the operating direction and fastened to ties having two ends, which comprises (a) an elongated carrier frame having two sides defining planes extending in the operating direction and the carrier frame having a forward half and a rear half, (b) two undercarriages respectively supporting the forward and rear carrier frame halves on the assembled track section for movement therealong, (1) each one of the undercarriages including a flanged wheel engaging a respective one of the rails for support of the elongated carrier frame on the assembled track section, (c) a device for advancing the carrier frame stepwise in the operating direction, the carrier frame advancing device including (1) two pairs of independently operable jacks arranged adjacent each other in the operating direction on each carrier frame half, each jack of each of said pairs being mounted at a respective one of the carrier frame sides outwardly spaced from a respective one of the tie ends, operation of the jacks vertically adjusting the jacks and enabling the jacks to engage the track bed, and (2) means for moving one of the pairs of jacks on each carrier frame half in relation to the other pair of jacks on each carrier frame half in the operating direction while the other pair of jacks engages the track bed and supports the elongated carrier frame thereon, and (d) rail gripping devices for detachably holding the assembled track section, each rail gripping device being adjustable transversely with respect to the operating direction.

2. The track-bound carriage of claim 1, further comprising a drive connected to each jack and operable to adjust the jack transversely with respect to the operating direction whereby the carrier frame advancing device is transversely adjustable, the drive providing a transverse adjustment range extending outwardly from an adjacent one of the tie ends.

3. The track-bound carriage of claim 2, wherein the jacks and drives comprise double-acting hydraulic piston-and-cylinder devices.

4. The track-bound carriage of claim 3, further comprising a central remote control for operating each one of the jacks and drives independently, the drives being operable into a retracted position wherein the carriage may pass freely within the normal profile of the track.

5. The track-bound carriage of claim 3, wherein the devices comprise telescoping parts of rectangular cross section and have substantially the same length.

6. The track-bound carriage of claim 5, wherein the outer ones of the telescoping parts of the drives are affixed to the elongated carrier frame, the outer telescoping parts of pairs of adjacent ones of the drives being offset from each other by 180°, and the outer ones of the telescoping parts of the jacks are affixed to the inner telescoping parts of the associated drives.

7. The track-bound carriage of claim 5, wherein the elongated carrier frame has a width fitting the carrier frame between the rails of the assembled track section, the carrier frame being centered between the rails and comprising (a) two parallel carrier struts extending in the operating direction, (1) the outer telescoping parts of one of the drives on each carrier frame half being affixed to the carrier struts and offset from the other one of the outer telescoping parts of the adjacent drive by 180°, and (b) an elongated beam extending between the two carrier struts and movable in the operating direction with respect to the carrier struts, the beam constituting the moving means and (1) the other outer telescoping parts of the adjacent drive being affixed to the elongated beam and the outer telescoping parts of the jacks being affixed to the inner telescoping parts of the drives.

8. The track-bound carriage of claim 7, wherein the elongated beam comprises two parallel carrier struts, each one of the elongated beam carrier struts having an elongated guide track, and further comprising guide rollers mounted on the carrier struts whereon the other pairs of jacks are mounted, the guide rollers engaging the elongated guide tracks.

9. The track-bound carriage of claim 8, wherein the carrier struts and the telescoping parts have the same rectangular cross section.

10. The track-bound carriage of claim 8, further drive means for moving the elongated beam in the operating direction forwardly of a front end of the carriage, the drive means comprising a motor mounted on the carrier struts and having a driving output, and a transmission connecting the motor driving output to the elongated beam.

11. The track-bound carriage of claim 10, wherein the motor is a hydraulic motor and the transmission comprises a rack-and-pinion drive, the range of the advancing movement of the drive means extending over at least three to four tie spacings.

12. The track-bound carriage of claim 1, wherein the elongated carrier frame has a width fitting the carrier frame between the rails of the assembled track section, the carrier frame being centered between the rails and comprising (a) two parallel carrier struts extending in the operating direction, (1) the other pair of jacks on each carrier frame half being mounted on the carrier struts, and (b) an elongated beam extending between the two carrier struts and movable in the operating direction with respect to the carrier struts, the beam constituting the moving means and (1) the one pair of jacks on each carrier frame half being mounted on the movable elongated beam.

13. The track-bound carriage of claim 12, wherein the elongated beam comprises two parallel carrier struts, each one of the elongated beam carrier struts having an elongated guide track, and further comprising guide rollers mounted on the carrier struts whereon the other pairs of jacks are mounted, the guide rollers engaging the elongated guide tracks.

14. The track-bound carriage of claim 1, further comprising a drive connected to each jack and operable to adjust the jack transversely with respect to the operating direction whereby the carrier frame advancing device is transversely adjustable, the drive providing a transverse adjustment range extending outwardly from an adjacent one of the tie ends, the jacks and drives being constituted by double-acting hydraulic piston-and-cylinder devices comprised of telescoping parts movable between a retracted and extended position, the drives extending beyond the carrier frame sides and having a length corresponding at least to the length of the ties in the retracted position and about to double the tie length in the extended position.

15. The track-bound carriage of claim 14, wherein a pair of said drives, which are adjustable in the operating direction relative to the carrier frame, and a pair of said drives, which are affixed to the carrier frame, and the jacks connected thereto transversely opposite the drives are arranged, respectively, ahead and behind the undercarriages in the operating direction, and a respective one of the rail gripping devices is arranged at each undercarriage.

16. The track-bound carriage of claim 15, wherein each one of the gripping devices comprises a vertically adjustable gripping hook opposite the flanged wheel of an associated one of the undercarriages, and drive means for vertically adjusting and transversely moving the gripping hook for respective engagement with the foot or the head of the associated rail.

17. The track-bound carriage of claim 16, further comprising a transverse beam affixed to the elongated carrier frame and supporting the flanged wheels and gripping devices of each undercarriage, and elongated guide means extending in the operating direction for adjustably positioning the transverse beam in said direction.

18. The track-bound carriage of claim 1, wherein each undercarriage is arranged between the adjacent pairs of jacks.

19. A mobile apparatus for receiving or laying a long assembled track section from or on a track bed and for transporting the assembled track section in an operating direction, the assembled track section consisting of rails extending in the operating direction and fastened to ties having two ends, which comprises at least two track-bound carriages according to claim 1.

* * * * *